US005818308A

United States Patent [19]

Tanaka et al.

[11] Patent Number: 5,818,308

[45] Date of Patent: Oct. 6, 1998

[54] COUPLED LINE ELEMENT

[75] Inventors: Hiroaki Tanaka, Mishima-gun; Takuya Hashimoto; Yasuaki Saitoh, both of Kyoto-shi, all of Japan

[73] Assignee: Murata Manufacturing Co., Ltd., Japan

[21] Appl. No.: 746,572

[22] Filed: Nov. 14, 1996

[30] Foreign Application Priority Data

Nov. 16, 1995 [JP] Japan ..... 7-298522
Oct. 8, 1996 [JP] Japan ..... 8-267131

[51] Int. Cl.[6] ..... H01P 5/18; H01P 5/10

[52] U.S. Cl. ..... 333/116; 333/26

[58] Field of Search ..... 333/26, 116

[56] References Cited

U.S. PATENT DOCUMENTS 3,332,039 7/1967 Oh ..... 333/116
5,369,379 11/1994 Fujiki ..... 333/116

FOREIGN PATENT DOCUMENTS 1475472 6/1977 United Kingdom .
1319119 6/1987 United Kingdom ..... 333/116
9532527 11/1995 WIPO .

OTHER PUBLICATIONS

U.K. Search Report dated 6 Jan. 1997.

*Primary Examiner*—Paul Gensler
*Attorney, Agent, or Firm*—Ostrolenk, Faber, Gerb & Soffen, LLP

[57] ABSTRACT

A coupled line element has a plurality of coupled lines equalized to each other in line length to set a phase difference between output signals within a desired range. The coupled lines are wound to form a spiral section. An extension is formed continuously with an end of one or more of the coupled lines forming an inner winding in the spiral section. The line length of this coupled line is thereby equalized to that of the coupled line forming an outermost winding in the spiral section. Alternatively, the coupled lines can be formed into two spiral sections which are wound in opposite directions.

10 Claims, 3 Drawing Sheets

COUPLED LINE ELEMENT

BACKGROUND OF THE INVENTION

1. Field of the Invention

The present invention relates generally to coupled line elements and, more particularly, to a coupled line element for use in a 90° hybrid coupler, a balun or the like.

2. Description of the Related Art

The construction of a conventional coupled line element for use in a 90° hybrid coupler will be described with reference to FIGS. 5 and 6.

A coupled line element 41 shown in FIGS. 5 and 6 has a substrate 42 which is made of a dielectric, e.g., a ceramic. A grounding electrode g is formed over the entire area of a reverse surface 42*a* of the substrate 42. A pair of coupled lines 43 and 44 formed of microstrip lines arranged for being coupled with each other through an electromagnetic field are provided on an obverse surface 42*b* of the substrate 42. The coupled lines 43 and 44 are wound parallel to each other to form a generally circular spiral section 45. In the spiral section 45, the coupled lines 43 and 44 form an outer winding and an inner winding, respectively, relative to each other. Electrode pads are respectively provided at opposite ends of the coupled line 43 to form an input terminal 46 and an output terminal 47. Similarly, electrode pads are provided at opposite ends of the coupled line 44 to form an output terminal 48 and an isolation terminal 49. The input terminal 46 and the output terminal 48 are aligned on the substrate 42 along a line represented by dot-dash line A while the output terminal 47 and the isolation terminal 49 are aligned on the substrate 42 along a line represented by dot-dash line B.

In the thus-constructed coupled line element 41, a wave incident on the input terminal 46 of the coupled line 43 is distributed to the output terminal 47 of the coupled line 43 and to the output terminal 48 of the coupled line 44, and signals having a phase difference approximately equal to 90° are thereby output from the output terminals 47 and 48. The isolation terminal 49 is non-reflectively terminated.

In the conventional coupled line element 41, however, the length of the winding coupled line 44 forming the inner winding in the spiral section 45 is shorter than that of the winding coupled line 43 forming the outer winding since each of the pair of the terminals 46 and 47 and the pair of terminals 48 and 49 of the coupled lines 43 and 44 are aligned as described above. Accordingly, if, for example, the line length of the coupled line 43 is set to achieve a length of $\lambda/4$, the line length of the coupled line 44 shorter than that of the coupled line 43 cannot be set to achieve the length of $\lambda/4$, so that a desired phase difference approximately equal to 90° cannot be obtained between the output signals from the coupled lines 43 and 44.

SUMMARY OF THE INVENTION

In view of the above-described problem, an object of the present invention is to provide a coupled line element in which the line lengths of a plurality of coupled lines are equalized to set a phase difference between output signals within a desired range.

To achieve this object, according to one aspect of the present invention, there is provided a coupled line element comprising a substrate and a plurality of coupled lines arranged on the substrate for being coupled with each other through an electromagnetic field. The coupled lines are wound parallel to each other so as to form a spiral section. The line lengths of the coupled lines are equalized to each other.

According to another aspect of the present invention, in the above-described coupled line element, an extension line is formed continuously with at least one of the opposite ends of at least one of the coupled lines forming an inner winding in the spiral section.

According to still another aspect of the present invention, in the above-described coupled line element, a second spiral section is formed continuously with the first spiral section so that the two spiral sections are substantially rotationally-symmetrical.

In the coupled line element in accordance with the present invention, the plurality of coupled lines forming the spiral section can be equalized in line length and the line lengths of the coupled lines can therefore be set to one value to achieve functioning at a desired wavelength. Consequently, the phase difference between two output signals from the coupled line element can be reliably set within a desired range.

Other features and advantages of the present invention will become apparent from the following description of the invention which refers to the accompanying drawings.

DESCRIPTION OF EMBODIMENTS OF THE INVENTION

A coupled line element which represents a first embodiment of the present invention and which is adapted for use in a 90° hybrid coupler will be described below with reference to FIGS. 1 and 2.

Figure 1:
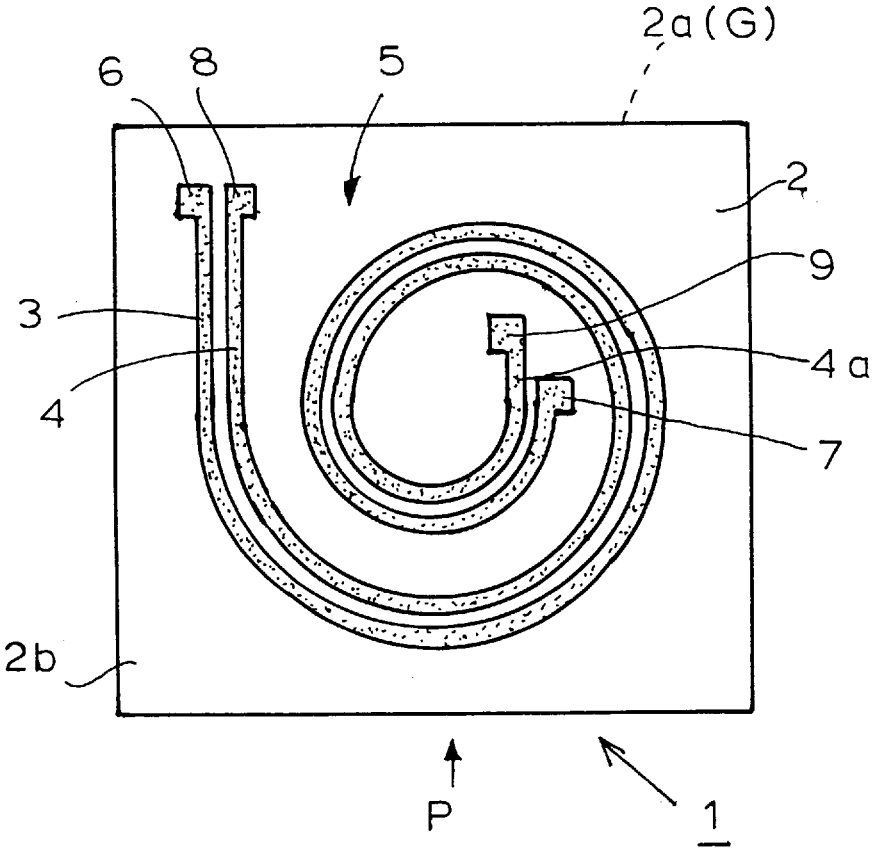
FIG. 1 is a top view of a coupled line element which represents a first embodiment of the present invention.
Figure 2:
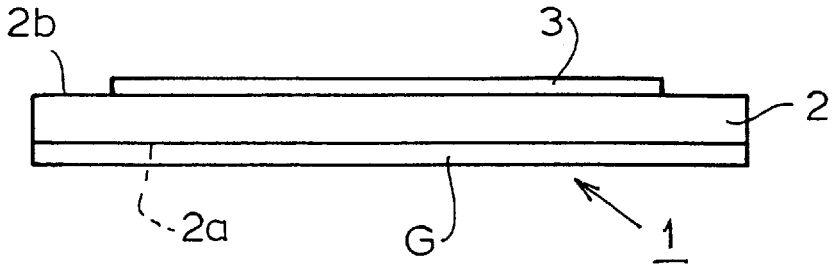
FIG. 2 is a side view of the coupled line element of FIG. 1 seen in the direction of arrow P.

A coupled line element 1 shown in FIGS. 1 and 2 has a substrate 2 which is made of a dielectric, e.g., a ceramic. A grounding electrode G is formed over the entire area of a reverse surface 2*a* of the substrate 2. A pair of coupled lines 3 and 4 formed of microstrip lines arranged for being coupled with each other through an electromagnetic field are provided on an obverse surface 2*b* of the substrate 2. The coupled lines 3 and 4 are wound parallel to each other to form a generally circular spiral section 5. In the spiral section 5, the coupled lines 3 and 4 form an outer winding and an inner winding, respectively, relative to each other.

Electrode pads are respectively provided at opposite ends of the coupled line 3 to form an input terminal 6 and an output terminal 7. On the other hand, an electrode pad is provided at one end of the coupled line 4 to form an output terminal 8 while an extension line 4*a* is provided at the other end of the coupled line 4. The extension line 4*a* is formed of a microstrip line continuously with the other end of the coupled line 4. An electrode pad is provided at the extreme end of the extension line 4*a* to form an isolation terminal 9.

In the thus-constructed coupled line element 1, a wave incident on the input terminal 6 of the coupled line 3 is distributed to the output terminal 7 of the coupled line 3 and to the output terminal 8 of the coupled line 4, and signals having a phase difference approximately equal to 90° are thereby output from the output terminals 7 and 8. The isolation terminal 9 is non-reflectively terminated.

In the coupled line element 1, the line lengths of the inner winding coupled line 4 and the outer winding coupled line 3 in the spiral section 5 can be equalized by selecting the length of the extension line 4*a*. Accordingly, both the line lengths of the coupled lines 3 and 4 can be set to one value to achieve a desired length with respect to a wavelength, e.g., $\lambda/4$. As a result, the phase difference between the output signals from the coupled lines 3 and 4 can be reliably set to a value approximately equal to the desired value of 90°.

A coupled line element which represents a second embodiment of the present invention and which is adapted for use in a balun will next be described with reference to FIG. 3. Components identical or corresponding to those of the first embodiment are indicated by the same reference characters and will not specifically be described.

Figure 3:
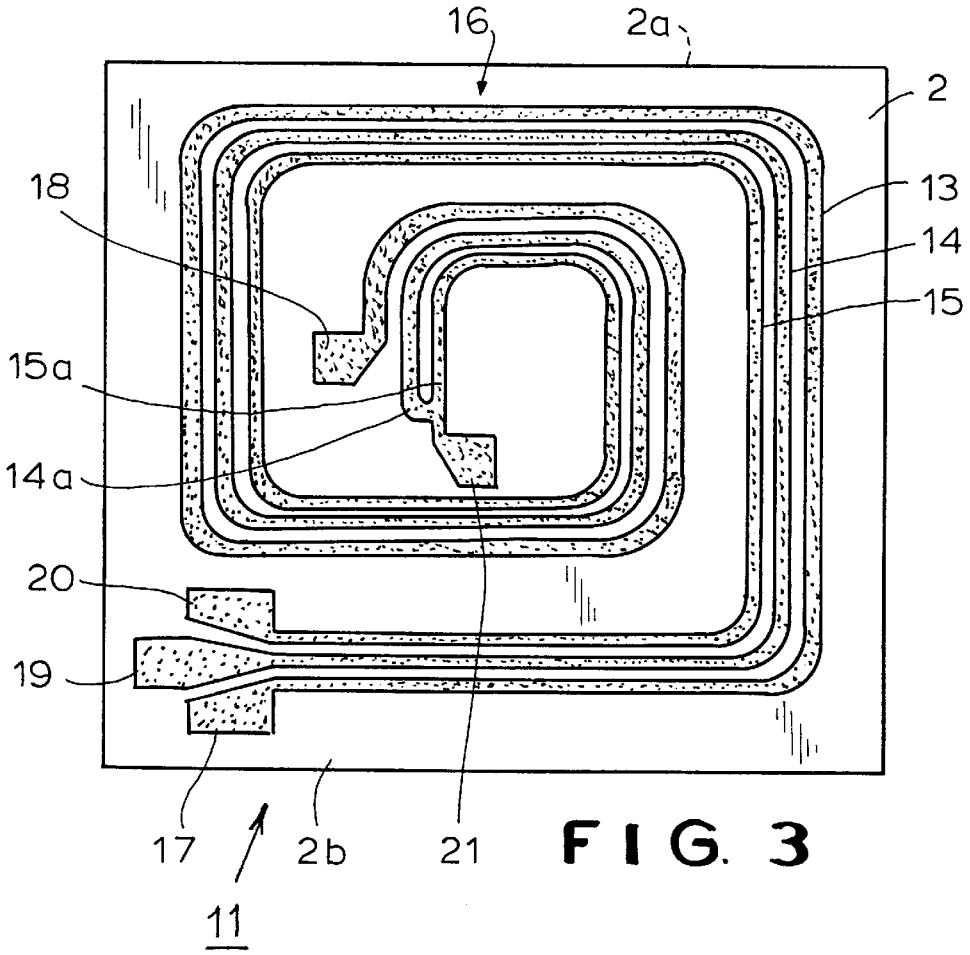
FIG. 3 is a top view of a coupled line element which represents a second embodiment of the present invention.

A coupled line element 11 shown in FIG. 3 has a substrate 2 having a grounding electrode (not shown) formed on its reverse surface 2*a*. Three coupled lines 13, 14, and 15 formed of microstrip lines arranged for being coupled with each other through an electromagnetic field are provided on an obverse surface 2*b* of the substrate 2. The coupled lines 13, 14, and 15 are wound parallel to each other to form a generally rectangular spiral section 16. In the spiral section 16, the coupled line 13 is wound as an outermost winding, the coupled line 14 is wound inside the coupled line 13, and the coupled line 15 is wound inside the coupled line 14.

Electrode pads are respectively provided at opposite ends of the coupled line 13 to form a grounding terminal 17 and an output terminal 18. Electrodes pads are respectively provided at corresponding ends of the coupled lines 14 and 15 to form an input terminal 19 and a grounding terminal 20. On the other hand, extension lines 14*a* and 15*a* are provided at the other ends of the coupled lines 14 and 15. Each of the extension lines 14*a* and 15*a* is formed of a microstrip line continuously with the other end of the coupled line 14 or 15. The extreme end of the extension line 14*a* is connected to the extension line 15*a* in the vicinity of the extreme end of the extension line 15*a*. An electrode pad is provided at the extreme end of the extension line 15*a* to form an output terminal 21.

In the thus-constructed coupled line element 11, a wave incident on the input terminal 19 of the coupled line 14 is distributed to the output terminal 18 of the coupled line 13 and to the output terminal 21 connected to the coupled lines 14 and 15, and signals having a phase difference approximately equal to 180° are thereby output from the output terminals 18 and 21.

In the coupled line element 11, the line lengths of the inner winding coupled lines 14 and 15 and the outer winding coupled line 13 in the spiral section 16 can be equalized by selecting the lengths of the extension lines 14*a* and 15*a*. Accordingly, the line lengths of the coupled lines 13, 14, and 15 can be set to one value to achieve a desired length with respect to a wavelength, for example, $\lambda/4$. As a result, the phase difference between the output signals from the coupled line 13 and the coupled lines 14 and 15 can be reliably set to a value approximately equal to the desired value of 180°.

A coupled line element which represents a third embodiment of the present invention and which is adapted for use in a 90° hybrid coupler will next be described with reference to FIG. 4. Components identical or corresponding to those of the first embodiment are indicated by the same reference characters and will not specifically be described.

Figure 4:
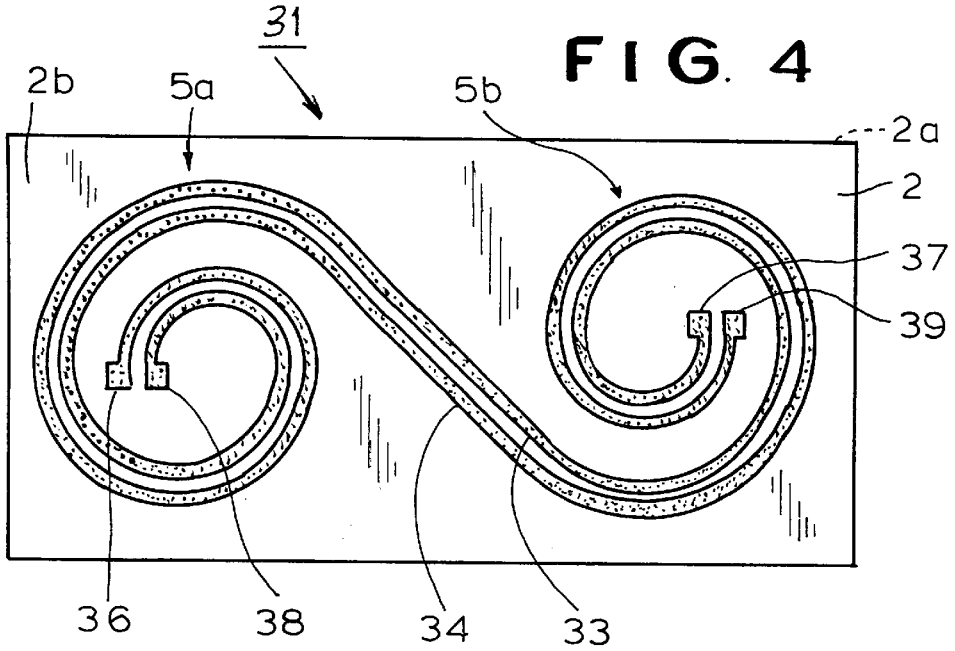
FIG. 4 is a top view of a coupled line element which represents a third embodiment of the present invention.
Figure 5:
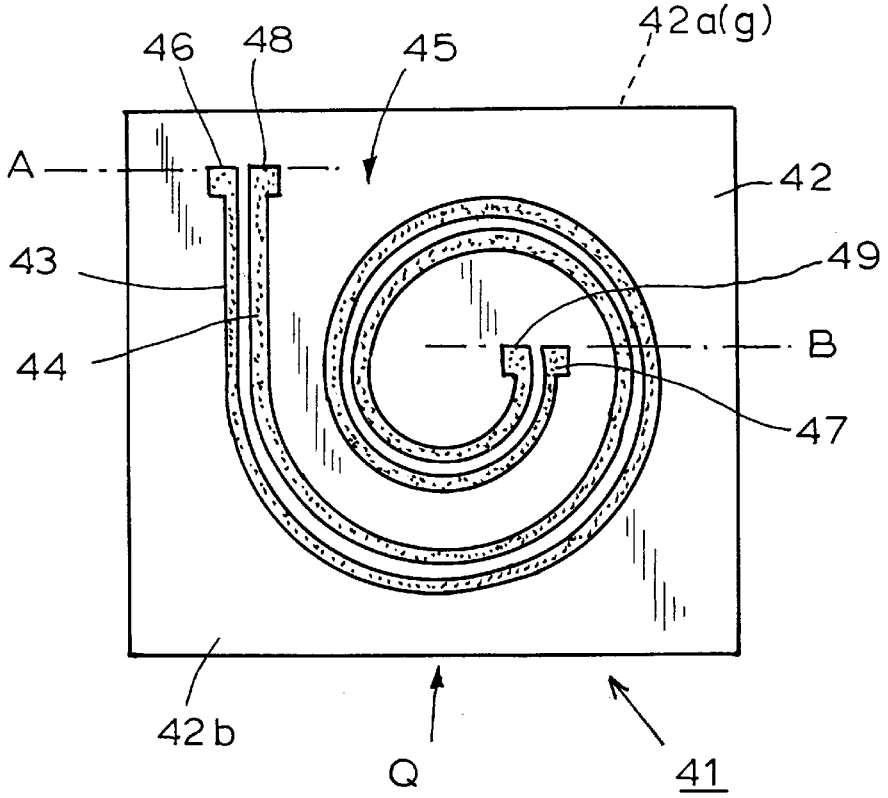
FIG. 5 (PRIOR ART)
FIG. 5 is a top view of a conventional coupled line element.
Figure 6:
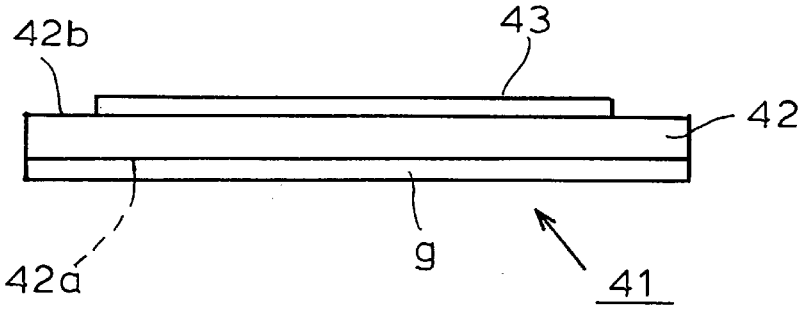
FIG. 6 (PRIOR ART)
FIG. 6 is a side view of the coupled line element of FIG. 5 seen in the direction of arrow Q.

A coupled line element 31 shown in FIG. 4 has a substrate 2 having a grounding electrode (not shown) formed on its reverse surface 2*a*. A pair of coupled lines 33 and 34 formed of microstrip lines coupled with each other through an electromagnetic field are provided on an obverse surface 2*b* of the substrate 2. The coupled lines 33 and 34 are wound parallel to each other to form spiral sections 5*a* and 5*b*. The spiral sections 5*a* and 5*b* are formed continuously and integrally with each other so as to be generally rotationally-symmetrical. The portions of the coupled lines 33 and 34 in the spiral section 5*a* and the spiral section 5*b* are wound in opposite directions. That is, the coupled line 33 forms an outer winding in the spiral section 5*a* and an inner winding in the spiral section 5*b* while the coupled line 34 forms an inner winding in the spiral section 5*a* and an outer winding in the spiral section 5*b*.

Electrode pads are respectively provided at opposite ends of the coupled line 33 to form an input terminal 36 and an output terminal 37 while electrode pads are respectively provided at opposite ends of the coupled line 34 to form an output terminal 38 and an isolation terminal 39.

In the thus-constructed coupled line element 31, a wave incident on the input terminal 36 of the coupled line 33 is distributed to the output terminal 37 of the coupled line 33 and to the output terminal 38 of the coupled line 34, and signals having a phase difference approximately equal to 90° are thereby output from the output terminals 37 and 38. The isolation terminal 39 is non-reflectively terminated.

In the coupled line element 31, the line lengths of the coupled lines 33 and 34 can be equalized by winding each of the coupled lines 33 and 34 at outer and inner positions so that the spiral portions 5*a* and 5*b* are formed continuously with each other. Accordingly, both the line lengths of the coupled lines 33 and 34 can be set to one value to achieve a desired length with respect to a wavelength, for example, $\lambda/4$. As a result, the phase difference between the output signals from the coupled lines 33 and 34 can be reliably set to a value approximately equal to the desired value of 90°.

In the above-described embodiments of the present invention, one spiral section or each of two spiral sections is formed so as to be generally circular or rectangular. However, coupled lines may be formed into any other shape to form one or two spiral sections.

In the above-described first and second embodiments, an extension line is provided at one end of a coupled line forming an inner winding. However, an extension line may alternatively be provided at the other end of the coupled line forming an inner winding. Further, extension lines may be provided at opposite ends of the coupled line.

The arrangement of the third embodiment has been described with respect to an application to a coupled line element for use in a 90° hybrid coupler. However, three coupled lines may be wound in the same manner to form two spiral sections for a coupled line element for use in a balun.

In the coupled line element in accordance with the present invention, a plurality of coupled lines forming a spiral section can be equalized in line length and the line lengths of the coupled lines can therefore be set to one value to achieve functioning at a desired wavelength. Consequently, the phase difference between two output signals from the coupled line element can be reliably set within a desired range.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A coupled line element comprising a substrate and a plurality of coupled lines provided on the substrate and arranged for being coupled with each other through an electromagnetic field, said coupled lines being wound substantially parallel to each other so as to form a parallel section, an input terminal and an output terminal being provided at respective ends of one said coupled line, an output terminal and an isolation terminal being provided at respective ends of another said coupled line, wherein respective line lengths of said coupled lines are substantially equalized to each other to provide a predetermined phase difference between respective output signals at said output terminals in response to an input signal at said input terminal, and wherein said respective line lengths are substantially equalized by an extension line which is formed continuously with a first end of a first said coupled line forming an inner winding in said parallel section, the opposite end of said first coupled line being substantially aligned with an adjacent end of the other of said coupled lines.

2. A coupled line element according to claim 1, wherein said predetermined phase difference is substantially 90°.

3. A coupled line element according to claim 1, wherein said isolation terminal is provided at an end of said extension line.

4. A coupled line element according to claim 1, wherein one of said output terminals is provided at an end of said extension line.

5. A coupled line element comprising a substrate and a plurality of coupled lines provided on the substrate and arranged for being coupled with each other through an electromagnetic field, said coupled lines being wound substantially parallel to each other so as to form a parallel section, an input terminal and an output terminal being provided at respective ends of one said coupled line, an output terminal and an isolation terminal being provided at respective ends of another said coupled line, wherein respective line lengths of said coupled lines are substantially equalized to each other to provide a predetermined phase difference between respective output signals at said output terminals in response to an input signal at said input terminal, and wherein one of said plurality of coupled lines comprises a pair of coupled lines in parallel with each other, connected together at a corresponding one of said output terminals, said predetermined phase difference being substantially 180°.

6. A coupled line element according to claim 5, wherein said respective line lengths are substantially equalized by a pair of extension lines which are formed continuously with said pair of coupled lines, respectively.

7. A coupled line element according to claim 6, wherein one of said output terminals is provided at an end of said pair of extension lines.

8. A coupled line element according to claim 5, wherein said respective line lengths are substantially equalized by an extension line which is formed continuously with a first end of a first said coupled line forming an inner winding in said parallel section.

9. A coupled line element according to claim 8, wherein the opposite end of said first coupled line is substantially aligned with an adjacent end of the other of said coupled lines.

10. A coupled line element according to claim 8, wherein one of said output terminals is provided at an end of said extension line.

* * * * *